US006129557A

United States Patent [19]

Blaszczyk et al.

[11] Patent Number: 6,129,557

[45] Date of Patent: Oct. 10, 2000

[54] APPARATUS AND METHOD FOR MOUNTING A TRANSITION CONNECTOR AND A TELEPHONE CONNECTOR BACK-TO-BACK ON A CIRCUIT BOARD

[75] Inventors: Marion Blaszczyk, Palos Hills; Dane L. Greives, Morton Grove; John J. Connell, Lake Zurich; Amir Koradia, Palatine, all of Ill.

[73] Assignee: 3COM Corporation, Rolling Meadows, Ill.

[21] Appl. No.: 09/206,575

[22] Filed: Dec. 7, 1998

[51] Int. Cl.[7] ..... H01R 12/00

[52] U.S. Cl. ..... 439/61; 439/76.1

[58] Field of Search ..... 439/61, 59, 60, 439/636, 637, 638, 639, 76.1, 62, 653, 654, 655

[56] References Cited

U.S. PATENT DOCUMENTS

| | | | |
|---|---|---|---|
| 3,551,874 | 12/1970 | Volinskie | 439/76.1 |
| 4,385,791 | 5/1983 | Lovrenich | 439/76.1 |
| 4,498,717 | 2/1985 | Reimer | 439/61 |
| 4,550,960 | 11/1985 | Asick et al. | 439/61 |
| 4,744,006 | 5/1988 | Duffield | 439/61 |
| 5,488,541 | 1/1996 | Mistry et al. | 439/62 |
| 5,649,829 | 7/1997 | Miller et al. | 439/76.1 |

*Primary Examiner*—Renee S. Luebke
*Assistant Examiner*—T C Patel
*Attorney, Agent, or Firm*—Baniak Nicholas; Pine & Gannon

[57] ABSTRACT

An apparatus for mounting a transition connector and a telephone connector back-to-back on circuit board is provided. A circuit board is adapted for placement in an electronic chassis and includes a front side and a back side. A transition connector is operatively connected to the front side of the circuit board. The transition connector includes a plurality of spaced apart pins arranged in a first row and a second opposing row. The first row is spaced apart from the second row a first distance. A telephone connector is operatively connected to the back side of the circuit board opposite the transition connector. The telephone connector includes a plurality of spaced apart pins arranged in a first line and a second opposing line. The first line is spaced apart from the second line a second distance. The first distance is greater than the second distance. The first and second lines are positioned between the first and second rows. The pins of the first row are operatively connected to the pins of the first line, and the pins of the second row are operatively connected to the pins of the second line.

12 Claims, 4 Drawing Sheets

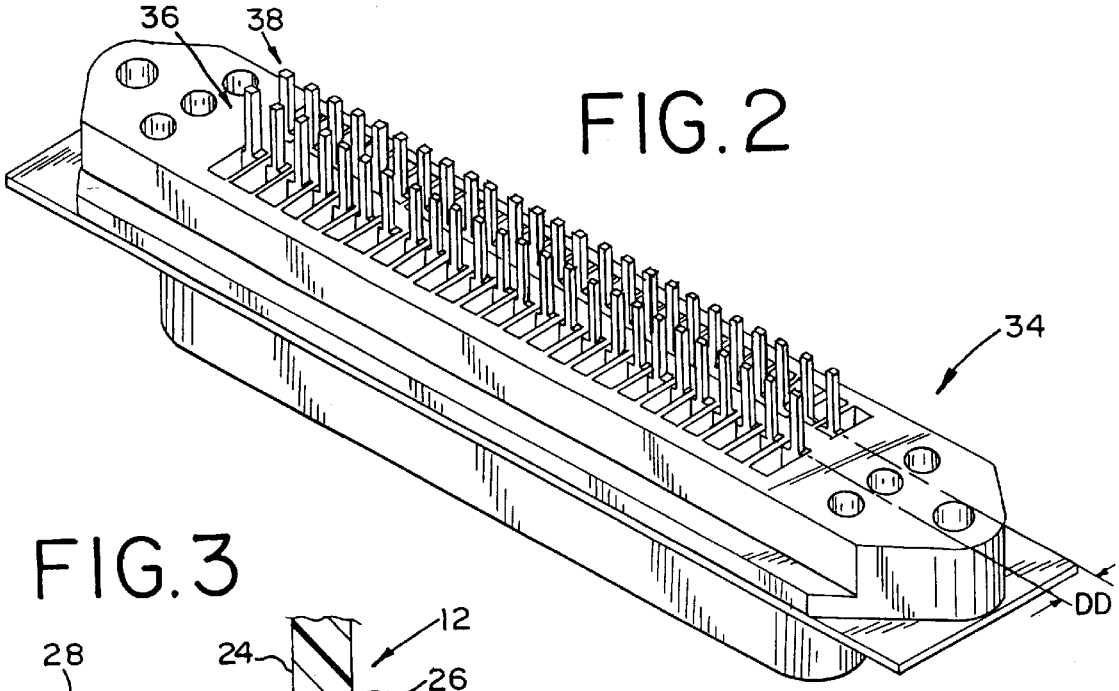
FIG. 2
FIG. 3
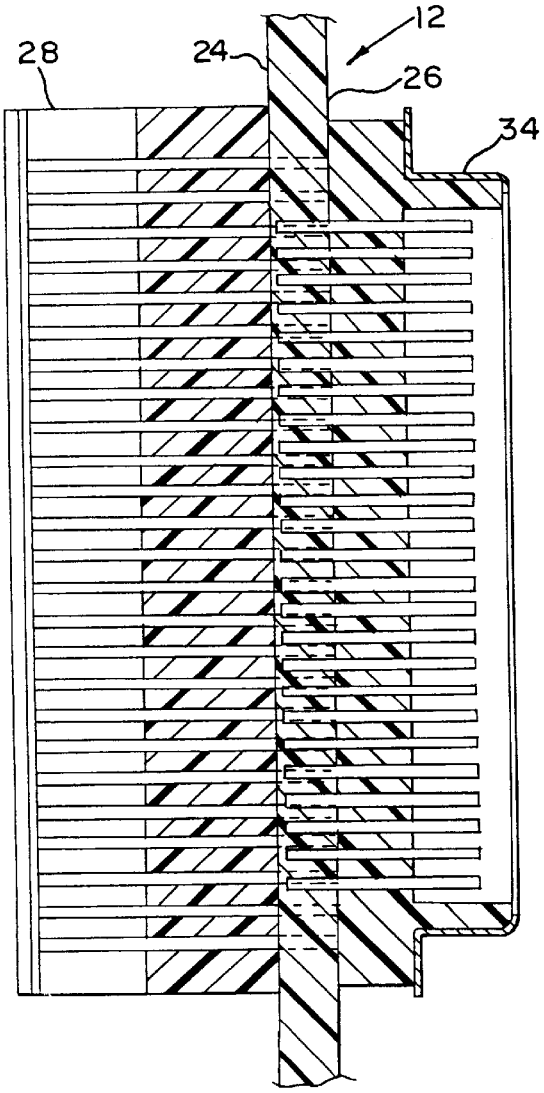
FIG. 4
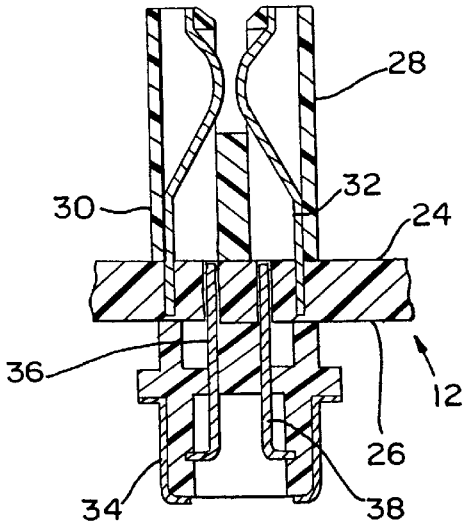

APPARATUS AND METHOD FOR MOUNTING A TRANSITION CONNECTOR AND A TELEPHONE CONNECTOR BACK-TO-BACK ON A CIRCUIT BOARD

FIELD OF THE INVENTION

This invention relates generally to the field of electrical connectors and in particular, to an apparatus and method for mounting a transition connector and a telephone connector back-to-back on a printed circuit board.

BACKGROUND OF THE INVENTION

Electronic chassis which house electronic components for high-speed telecommunication and networking applications typically include a plurality of vertically oriented circuit boards commonly referred to as daughtercards. When the daughtercards are fully inserted into the chassis, they are inserted into transition connectors that are mounted on the inside surface of a printed circuit board. The printed circuit board, commonly referred to as a back plane printed circuit board, is positioned along the back side of the electronic chassis.

Each transition connector has a plurality of pins that are inserted into plated thru holes in the back plane printed circuit board. For each transition connector, there is typically a corresponding telephone connector mounted on the outside surface of the back plane printed circuit board. Each telephone connector also has a plurality of pins that are inserted into plated thru holes in the back plane circuit board. The telephone connectors are typically offset from the transition connectors in order to comply with the Bellcore (Bell Communications Research) standards for telecommunications, which set forth the minimum spacing requirements between pads. The telephone connectors receive telephone-input cables, which connect the motherboards mounted in the chassis to a telephone network.

FIG. 9 shows a typical arrangement of a conventional telephone connector 50 offset from a conventional transition connector 52. The disadvantage of this arrangement is that a considerable amount of space is used on the back plane printed circuit board due to the offset configuration. Moreover, as shown in FIG. 9, the offset configuration results in the need for long solder traces to make the electrical connections between pins of the transition connector 52 and the pins of the telephone connector 50. The length of each trace increases manufacturing costs and results in decreased signal integrity. Moreover, due to the minimum space requirements between traces, the traces themselves occupy a considerable amount of space on the back plane printed circuit board.

Accordingly, it would be desirable to have an apparatus for mounting a transition connector and a telephone connector back-to-back on a circuit board that overcomes the disadvantages described above.

SUMMARY OF THE INVENTION

One aspect of the invention provides an apparatus for mounting a transition connector and a telephone connector back-to-back on a circuit board. A circuit board is adapted for placement in an electronic chassis and includes a front side and back side. A transition connector is operatively connected to the front side of the circuit board and includes a plurality of spaced apart pins arranged in a first row and a second opposing row. The first row is spaced apart from the second row a first distance. A telephone connector is operatively connected to the back side of the circuit board opposite the transition connector. The telephone connector includes a plurality of spaced apart pins arranged in a first line and a second opposing line. The first line is spaced apart from the second line a second distance, the first distance being greater than the second distance. The first and second lines are positioned between the first and second rows. The pins of the first row are operatively connected to the pins of the first line, and the pins of the second row are operatively connected to the pins of the second line. The circuit board may preferably be a printed circuit board. The first and second rows each may preferably include 25 pins, and the first and second lines each may preferably include 25 pins. The first distance may preferably be 0.300 inches and the second distance may preferably be 0.160 inches. A motherboard may preferably be adapted for placement in the electronic chassis and may include an edge. At least one daughtercard may preferably be mounted along the edge. The at least one daughtercard may preferably be inserted into the transition connector.

Another aspect of the invention provides an apparatus for mounting a transition connector and a telephone connector back-to-back on a circuit board. An electronic chassis is provided. A printed circuit board is housed in the electronic chassis and includes a front side and back side. A transition connector is operatively connected to the front side of the printed circuit board and includes a plurality of spaced apart pins arranged in a first row and a second opposing row. The first row is spaced apart from the second row a first distance. A telephone connector is operatively connected to the back side of the printed circuit board opposite the transition connector. The telephone connector includes a plurality of spaced apart pins arranged in a first line and a second opposing line. The first line is spaced apart from the second line a second distance, the first distance being greater than the second distance. The first and second lines are positioned between the first and second rows. The pins of the first row are operatively connected to the pins of the first line, and the pins of the second row are operatively connected to the pins of the second line. A motherboard having an edge may preferably be inserted into the electronic chassis. At least one daughtercard may preferably be mounted along the edge. The at least one daughtercard may preferably be inserted into the transition connector.

Another aspect of the invention provides a method of mounting a transition connector and a telephone connector back-to-back on a circuit board. A circuit board adapted for placement in an electronic chassis including a front side and back side is provided. A transition connector including a plurality of spaced apart pins arranged in a first row and a second opposing row is also provided. The first row is spaced apart from the second row a first distance. A telephone connector including a plurality of spaced apart pins arranged in a first line and a second line is also provided. The first line is spaced apart from the second line a second distance. The first distance is greater than the second distance. The transition connector is operatively connected to the front side of the circuit board. The first and second lines are positioned between the first and second rows. The telephone connector is operatively connected to the back side of the circuit board opposite the transition connector. The pins of the first row are operatively connected to the pins of the first line, and the pins of the second row are operatively connected to the pins of the second line. A motherboard adapted for placement in the electronic chassis including an edge may also be provided. At least one daughtercard may preferably be mounted along the edge.

The at least one daughtercard may preferably be inserted into the transition connector.

Another aspect of the invention provides a method of mounting a transition connector and a telephone connector back-to-back on a circuit board. An electronic chassis is provided. A printed circuit board housed in the electronic chassis is also provided. The printed circuit board includes a front side and back side. A transition connector includes a plurality of spaced apart pins arranged in a first row and a second opposing row. The first row is spaced apart from the second row a first distance. A telephone connector is operatively connected to the back side of the back plane printed circuit board opposite the transition connector. The telephone connector includes a plurality of spaced apart pins arranged in a first line and a second line. The first line is spaced apart from the second line a second distance. The first distance is greater than the second distance. The first and second lines are positioned between the first and second rows. The pins of the first row are operatively connected to the pins of the first line, and the pins of the second row are operatively connected to the pins of the second line. The transition connector is operatively connected to the front side of the printed circuit board. The first and second lines are positioned between the first and second rows. The telephone connector is connected to the back side of the printed circuit board opposite the transition connector. The pins of the first row are connected to the pins of the first line. The pins of the second row are connected to the pins of the second line. A motherboard including an edge may also be provided. At least one daughtercard may preferably be mounted along the edge. The motherboard may preferably be inserted into the electronic chassis. Then at least one daughtercard may preferably be inserted into the transition connector.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

BRIEF DESCRIPTION OF THE DRAWINGS

FIG. 2 is a perspective view of a preferred embodiment of a telephone connector;

FIG. 3 is a sectional view of a preferred embodiment of an apparatus for mounting a transition connector and a telephone connector back-to-back on a circuit board taken along the length of the apparatus;

FIG. 4 is a sectional view of a preferred embodiment of an apparatus for mounting a transition connector and a telephone connector back-to-back on a circuit board taken along the width of the apparatus;

DETAILED DESCRIPTION OF THE PRESENTLY PREFERRED EMBODIMENTS

Figure 1:
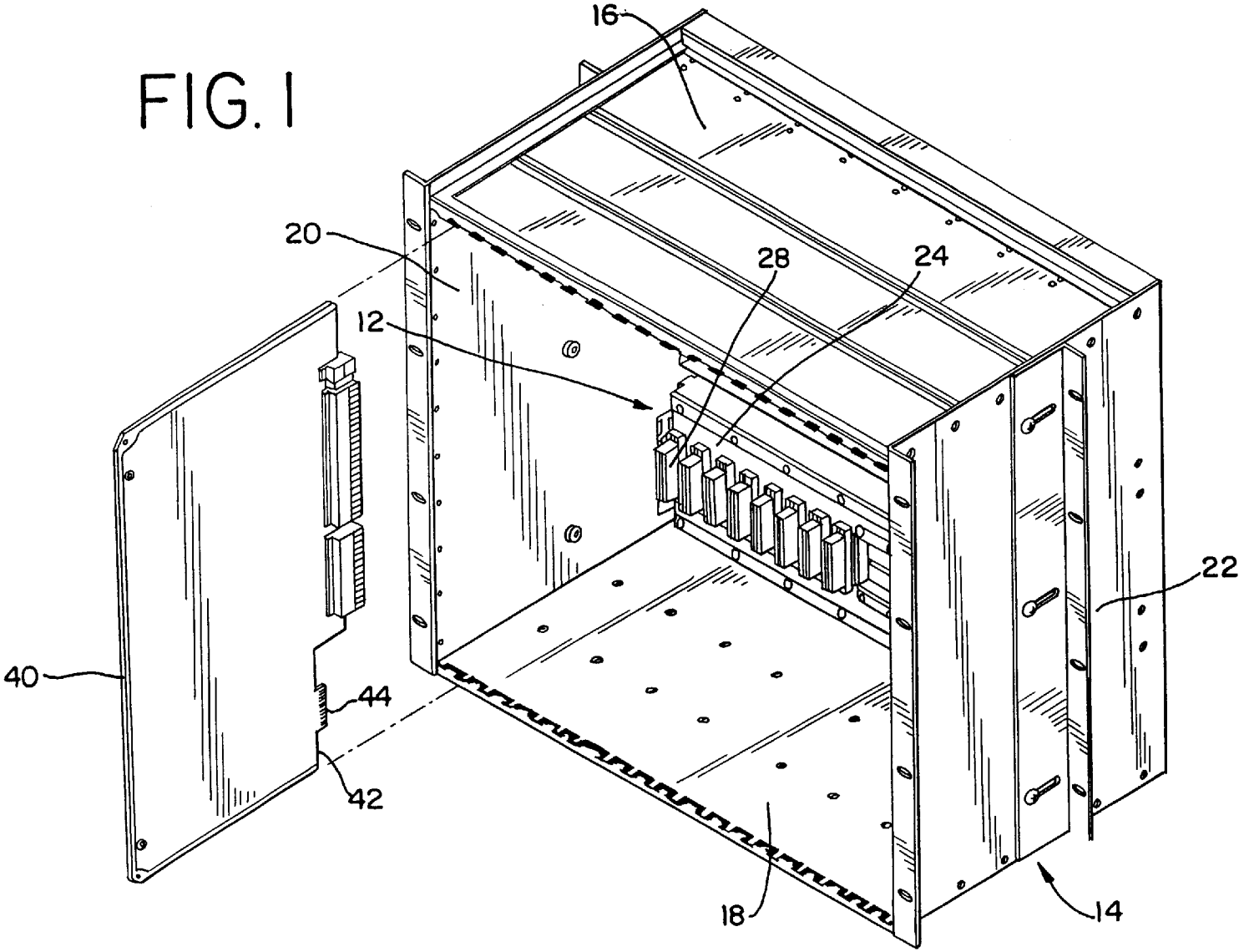
FIG. 1 is a perspective view of a preferred embodiment of an apparatus for mounting a transition connector and a telephone connector back-to-back on a circuit board mounted in an electronic chassis with an exploded view of a motherboard.

As shown in FIGS. 1–8, a preferred embodiment of an apparatus for mounting a transition connector and a telephone connector back-to-back on a circuit board includes a circuit board 12 adapted for placement in an electronic chassis 14. As shown in FIG. 1, the electronic chassis 14 includes a top wall 16, a bottom wall 18, a first side wall 20 and a second side wall 22. The top wall 16 and the bottom wall 18 are substantially parallel to one another. Similarly, the first side wall 20 and the second side wall 22 are substantially parallel to one another. In the embodiment shown, the top wall 16, the bottom wall 18, and the first and second side walls 20, 22 are configured in such a manner as to define an electronic chassis 14 having a generally rectangular shape. However, various alternative configurations of the electronic chassis 14 are contemplated. The electronic chassis 14 may be any suitable metal enclosure for housing various electronic components that carry out various functions such as, for example, telecommunications and networking functions. The electronic chassis 14 may preferably be comprised of any suitable rigid metal including, for example, steel.

In the embodiment shown in FIG. 1, the circuit board 12 is mounted along the back side of the electronic chassis 12. As shown in FIGS. 3 and 4, the circuit board 12 is a generally planar member and includes a front side 24 and a back side 26. The circuit board 12 may preferably be any of the conventional printed circuit boards (commonly referred to as back plane printed circuit boards) suitable for supporting a variety of electronic components such as, for example, telephone connectors and transition connectors. The circuit board 12 may preferably have a plurality of conventional solder pad openings for receiving the pins of the various connector components. Solder pads may preferably be electrically connected to other solder pads by solder traces that are etched onto the circuit board 12 by conventional soldering techniques. In the embodiment shown, the circuit board 12 has a thickness of 0.190 inches, although the thickness of the circuit board 12 may vary depending upon the particular application.

Figure 5:
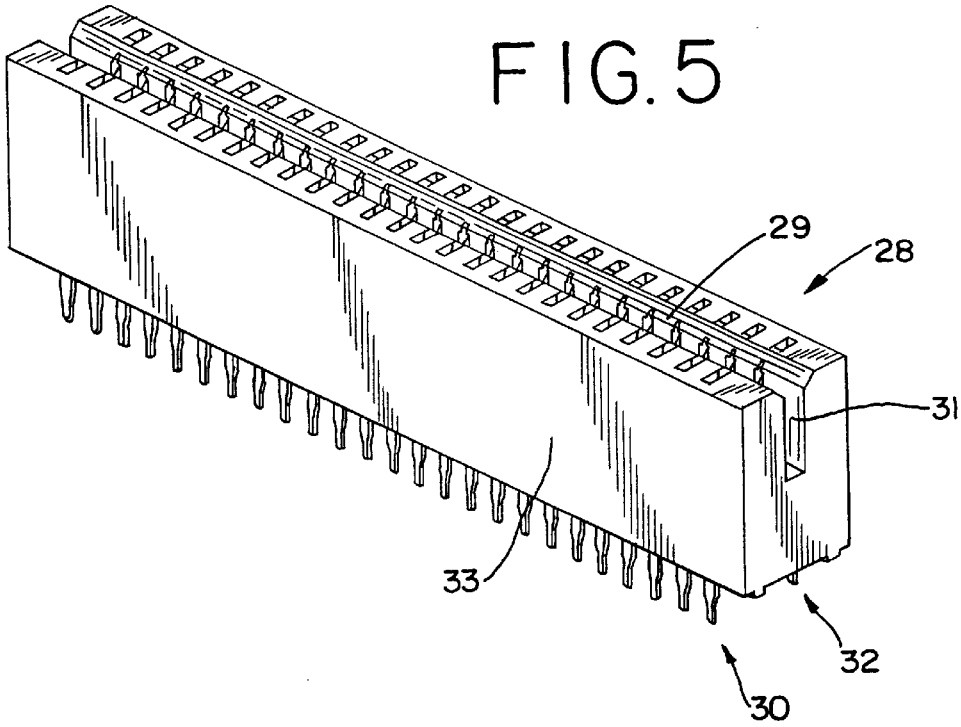
FIG. 5 is a perspective view of a preferred embodiment of a transition connector.
Figure 6:
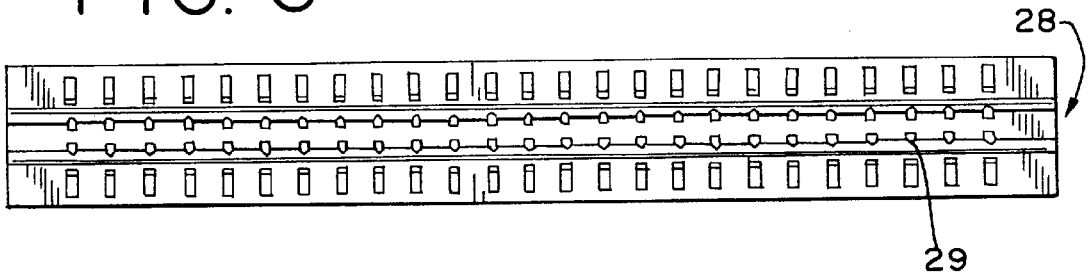
FIG. 6 is a top view of FIG. 5.
Figure 7:
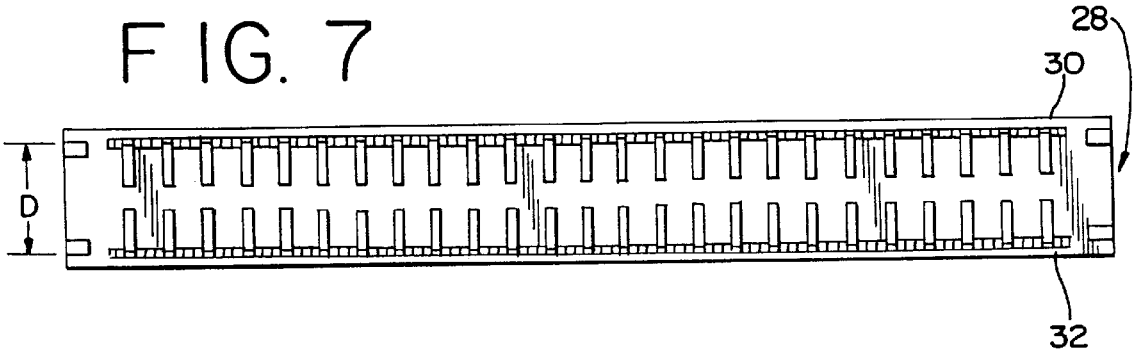
FIG. 7 is a bottom view of FIG. 5.

As shown in FIGS. 1, 3 and 4, a transition connector 28 is operatively connected to the front side 24 of the circuit board 12. As shown in FIGS. 5, 6, and 7, the transition connector 28 includes a plurality of spaced apart pins arranged in a first row 30 and a second opposing row 32. The first and second rows 30, 32 each may preferably include 25 pins. The pins may preferably be press-fitted into a predetermined pattern of solder pad openings in the circuit board 12. As shown in FIG. 7, the first row 30 is spaced apart from the second row 32 a first distance D. In the embodiment shown, the first distance D may preferably be 0.300 inches, although other distances may be used depending upon the particular application and various factors such as, for example, the solder pad openings of the circuit board 12. The first and second rows 30, 32 of pins may preferably be in communication with conductive elements 29 that are recessed in a slot 31 formed in an insulative housing 33 of the transition connector 28. The slot 31 may preferably extend along the length of the housing 33 to receive, for example, the printed circuit board fingers of a daughtercard.

Figure 8:
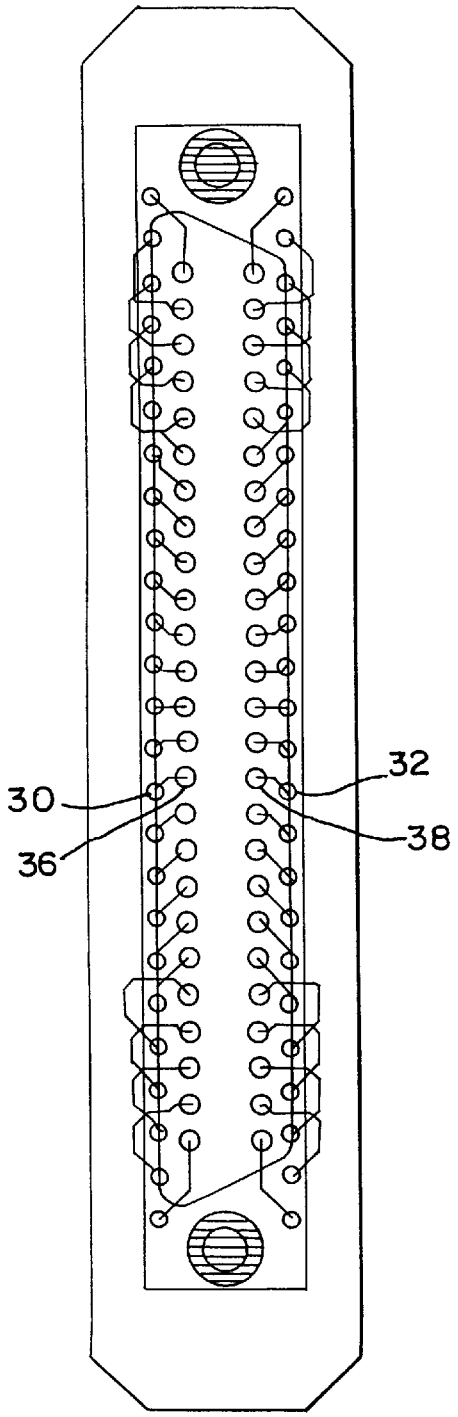
FIG. 8 is a diagrammatic view of a preferred embodiment showing the electrical connections between the pins of a transition connector and the pins of a telephone connector when the transition connector and the telephone connector are mounted back-to-back on a circuit board.
Figure 9:
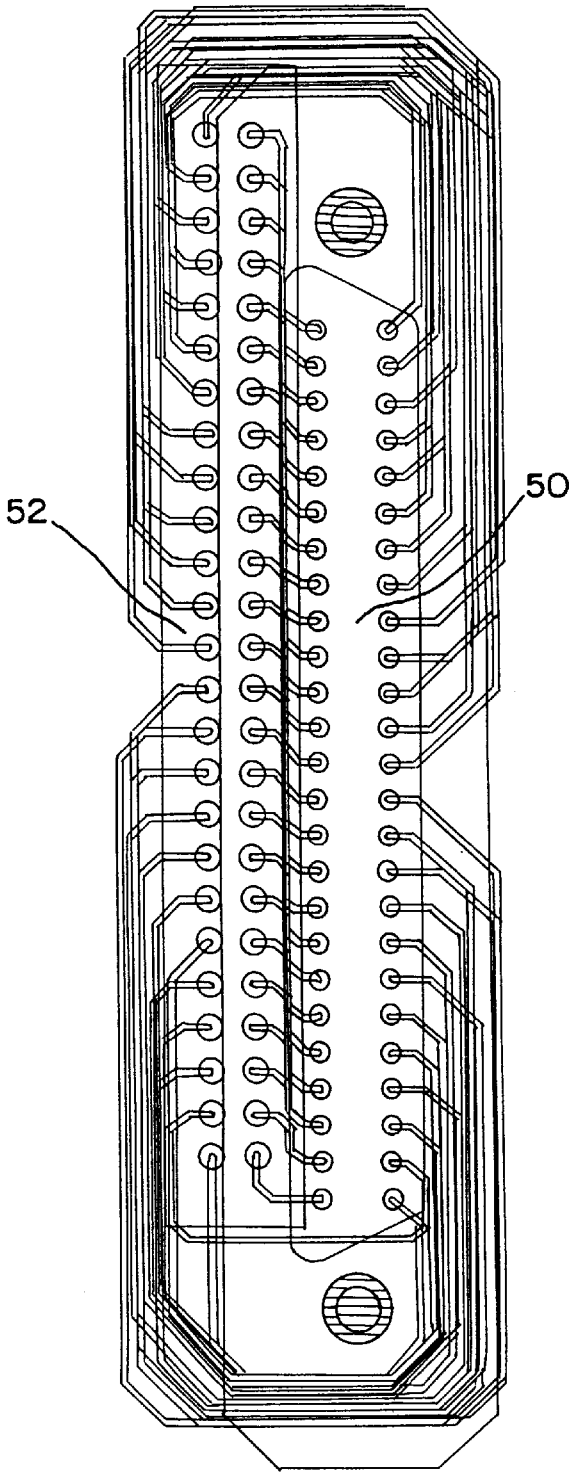
FIG. 9 is a diagrammatic view showing the electrical connections between the pins of a conventional transition connector and the pins of a conventional telephone connector when the transition connector is offset from the telephone connector.

As shown in FIGS. 3 and 4, a telephone connector 34 is operatively connected to the back side 26 of the circuit board 12 and opposite the transition connector 28. The telephone connector 34 may be any of the commercially available Telco (telephone company) connectors such as, for example, the Champ Connector manufactured by Amp Inc. and the Micro-Ribbon Connector manufactured by Amphenol. As shown in FIG. 2, the telephone connector 34 includes a plurality of spaced apart pins arranged in a first line 36 and a second opposing line 38. The first and second lines 36, 38 each may preferably include 25 pins. Each of the pins may preferably be press-fitted into a predetermined pattern of solder pad openings in the circuit board 12. The first line 36 of pins is spaced apart from the second line 38 of pins a second distance DD. The second distance DD may preferably be 0.160 inches, although other distances may be used depending upon the particular application. As shown in FIG. 4, the distance between the first and second rows of pins 30, 32 of the transition connector 28 is greater than the distance between the first and second lines 36, 38 of pins of the telephone connector 34. In the embodiment shown, the first and second lines 36, 38 of pins of the telephone connector 34 are positioned between the first and second rows 30, 32 of pins of the transition connector 28. As shown in FIG. 8, the pins of the first row 30 are operatively connected to the pins of the first line 36, and the pins of the second row 32 are operatively connected to the pins of the second line 38. Solder traces in the circuit board 12 may be used to electrically connect the first and second rows 30, 32 of pins to the first and second lines 36, 38 of pins. The advantage of this arrangement is that the transition connector 28 and the telephone connector 34 can be mounted back-to-back thereby maximizing the space on the circuit board 12. Moreover, as shown in FIG. 8, this arrangement substantially reduces the length of the solder traces required to make the interconnections between pins. This increases signal integrity and reduces manufacturing costs. Finally, this arrangement allows the connectors to be in close proximity to one another and, at the same time, complies with the Bellcore requirements for telecommunications.

As shown in FIG. 1, a motherboard 40 may preferably be adapted for placement in the electronic chassis 14. The motherboard 40 may be any of the commercially available printed circuit boards suitable for supporting a variety of electronic components. The motherboard 40 preferably includes an edge 42, and at least one daughtercard 44 mounted along the edge 42. When the motherboard 40 is inserted into the chassis 14, the daughtercard 44 may preferably be inserted into the transition connector 28. A telephone-input cable may preferably be connected to the telephone connector 34 to connect the motherboard 40 to a telephone network.

The apparatus can be easily assembled by connecting the transition connector 28 to the front side 24 of the circuit board 12. In particular, the first and second rows 30, 32 of pins of the transition connector 28 may preferably be press-fitted into a predetermined pattern of solder pad openings in the circuit board 12. The first and second lines 36, 38 of pins of the telephone connector 34 are then positioned on the back side 26 of the circuit board 12 between the first and second rows 30, 32 of pins of the transition connector 28. The telephone connector 34 is then connected to the back side 26 of the circuit board 12 opposite the transition connector 28. In particular, the first and second lines 36, 38 of pins of telephone connector 34 may preferably be press-fitted into a predetermined pattern of solder pad openings in the circuit board 12. The pins of the first row 30 are thereby operatively connected to the pins of the first line 36, and the pins of the second row 32 are operatively connected to the pins of the second line 38. The motherboard 40 is preferably inserted into the electronic chassis 14, and the daughtercard 44 is preferably inserted into the transition connector 28. A telephone-input cable may preferably be connected to the telephone connector 34 to connect the motherboard 40 to a telephone network.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An apparatus for mounting a transition connector and a telephone connector back-to-back on a circuit board comprising:

a circuit board, the circuit board including a front side and a back side, a transition connector mounted to the front side of the circuit board, the transition connector including a plurality of spaced apart pins arranged in a first row and a second opposing row, the first row spaced apart from the second row a first distance, a telephone connector mounted to the back side of the circuit board opposite the transition connector, the telephone connector including a plurality of spaced apart pins arranged in a first line and a second opposing line, the first line spaced apart from the second line a second distance, the first distance being greater than the second distance, the first and second lines positioned between the first and second rows, the pins of the first row electrically connected to the pins of the first line, and the pins of the second row electrically connected to the pins of the second line.

2. The apparatus of claim 1 wherein the circuit board is a printed circuit board.

3. The apparatus of claim 1 wherein the first and second rows each include 25 pins and the first and second lines each include 25 pins.

4. The apparatus of claim 1 wherein the first distance is 0.300 inches.

5. The apparatus of claim 1 wherein the second distance is 0.160 inches.

6. The apparatus of claim 1 further comprising a motherboard adapted for placement in the electronic chassis including an edge, at least one daughtercard mounted along the edge wherein the at least one daughtercard is inserted into the transition connector.

7. An apparatus for mounting a transition connector and a telephone connector back-to back on a circuit board comprising:

an electronic chassis, a printed circuit board housed in the electronic chassis, the printed circuit board including a front side and a back side, a transition connector mounted to the front side of the printed circuit board, the transition connector including a plurality of spaced apart pins arranged in a first row and a second opposing row, the first row spaced apart from the second row a first distance, a telephone connector mounted to the back side of the back plane printed circuit board opposite the transition connector, the telephone connector including a plurality of spaced apart pins arranged in a first line and a second opposing line, the first line spaced apart from the second line a second distance, the first distance being greater than the second distance, the first and second lines positioned between the first and second rows, the pins of the first row electrically connected to the pins of the first line, and the pins of the second row electrically connected to the pins of the second line.

8. The apparatus of claim 7 further comprising a motherboard inserted in the electronic chassis, the motherboard including an edge, at least one daughtercard mounted along the edge wherein the at least one daughtercard is inserted into the transition connector.

9. A method of mounting a transition connector and a telephone connector back-to-back on a circuit board comprising:

providing a circuit board, the circuit board including a front side and a back side, a transition connector including a plurality of spaced apart pins arranged in a first row and a second opposing row, the first row spaced apart from the second row a first distance, a telephone connector including a plurality of spaced apart pins arranged in a first line and a second line, the first line spaced apart from the second line a second distance, the first distance being greater than the second distance;

mounting the transition connector to the front side of the circuit board;

positioning the first and second lines between the first and second rows;

mounting the telephone connector to the back side of the circuit board opposite the transition connector;

electrically connecting the pins of the first row to the pins of the first line; and electrically connecting the pins of the second row to the pins of the second line.

10. The method of claim 9 further comprising:

providing a motherboard adapted for placement in the electronic chassis including an edge, at least one daughtercard mounted along the edge; and inserting the at least one daughtercard into the transition connector.

11. A method of mounting a transition connector and a telephone connector to a circuit board comprising:

an electronic chassis, a printed circuit board housed in the electronic chassis, the printed circuit board including a front side and a back side, a transition connector including a plurality of spaced apart pins arranged in a first row and a second opposing row, the first row spaced apart from the second row a first distance, a telephone connector including a plurality of spaced apart pins arranged in a first line and a second opposing line, the first line spaced apart from the second line a second distance, the first distance being greater than the second distance;

mounting the transition connector to the front side of the printed circuit board;

positioning the first and second lines between the first and second rows;

mounting the telephone connector to the back side of the printed circuit board and opposite the transition connector;

electrically connecting the pins of the first row to the pins of the first line, and electrically connecting the pins of the second row to the pins of the second line.

12. The method of claim 11 further comprising a motherboard including an edge, at least one daughtercard mounted along the edge;

inserting the motherboard into the electronic chassis; and inserting the at least one daughtercard into the transition connector.

* * * * *